United States Patent [19]

Sherman

[11] Patent Number: 4,501,308

Date of Patent: Feb. 26, 1985

[54] HINGE TEMPLATE GUIDE WITH HOLDING PINS

[76] Inventor: Frank E. Sherman, 2050 Federal, Costa Mesa, Calif. 92627

[21] Appl. No.: 494,945

[22] Filed: May 16, 1983

[51] Int. Cl.[3] ..... B27F 5/12

[52] U.S. Cl. ..... 144/144.5; 33/DIG. 10; 33/180 R; 33/197; 144/27; 409/178

[58] Field of Search ..... 144/27, 144 R, 144.5; 33/DIG. 10, 194, 197, 180 A, 180 R; 409/178, 182

[56] References Cited

U.S. PATENT DOCUMENTS

| | | | |
|---|---|---|---|
| 3,150,452 | 9/1964 | Meuwissen | 144/144.5 |
| 3,519,043 | 7/1970 | Guill | 144/144.5 |
| 3,559,704 | 2/1971 | Thompson | 144/144.5 |
| 3,823,754 | 7/1974 | Nix | 144/144.5 |
| 4,202,388 | 5/1980 | Wieting | 144/144.5 |
| 4,359,302 | 11/1982 | Payne | 144/144.5 |

*Primary Examiner*—W. D. Bray

*Attorney, Agent, or Firm*—George F. Bethel; Patience K. Bethel

[57] ABSTRACT

The following specification sets forth a hinge template guide. The hinge template guide facilitates routing of a door jam or frame by means of a router within a prescribed pattern formed by the template. The template has an opening therein for moving the router over the door frame or jam in a prescribed manner so as to cut an opening within the jam for mounting a hinge. The template guide is supported by means of sharpened pins which are driven into the door jam on a temporary basis and are removed by pivotal lever arms mounted on a bracket that are spring biased and journaled for removal of the pins by a levered removal thereof. The entire template is adjustable with regard to the dimensions that are to be cut by means of a rotatable adjustment means for providing the template at a specified margin on the door jam.

18 Claims, 7 Drawing Figures

HINGE TEMPLATE GUIDE WITH HOLDING PINS

BACKGROUND OF THE INVENTION

1. Field of the Invention

The field of this invention lies within the carpentry field. More particularly, it lies within the field of providing a template or guide for mounting a door hinge.

Door hinges are generally mounted on jams by means of routing, or removing an area of the door jam in order to seat the hinge in flush relationship on the jam or frame. The flush seating is provided by routing out a portion of the door jam or frame, so that the hinge can be seated therein on a pre-established basis.

Templates have been devised in the prior art in order to perform this, so that a routing can take place of the seat in which the hinge is to be seated on the door jam. This invention specifically relates to the field of door jam and door hinge templates that can be used as a guide for mounting hinges.

2. The Prior Art

The prior art with regard to templates for mounting hinges has consisted of templates of various sizes and shapes. These templates of various sizes and shapes were for accommodating a router to be moved within the template opening that conforms to variously sized and shaped hinges. These templates are generally implaced in adjacent relationship to a door jam and held by various means. Certain means of the prior art have included clamps, as well as other holding means.

One particular prior art template for providing a routing guide for hinges, has incorporated sharpened pins therewith. The pins are held in the template in a manner whereby they can be moved through the template for holding it in place.

The pins are seated within the template in a manner whereby they can be used analogously to nails for nailing the template into the door jam or frame to hold it. After the pins have been driven into the door jam or frame through the guide, they hold the template in place.

A deficiency of the foregoing structure, is that such templates are very difficult to remove. They are virtually like affixing a template to an area that is to be routed and securing it by nailing it to the surrounding area. Of course, after being nailed to the surrounding area, the nails or pins must be removed in order to withdraw the template. Such analogous action is hardly conducive to a rapid and facile routing of recesses for hinges within door jams.

This invention has overcome the foregoing deficiencies of the prior art by allowing for a levered removal of such pins through spring biased lever arms. The spring biased lever arms are such that they are pivotally connected by means of an axle and a support bracket. In this manner, the pins can be readily removed by an easily effectuated tap of the lever arms to pull the pins from the door jam and provide attendant removal of the template.

The lever arms can be such that they are pivotally connected to an upstanding bracket having an axle, rod or pin passing therethrough for pivotal movement of the lever arm. In addition to the foregoing easily removed pins of this invention, the invention also incorporates the ability to allow for different margins of the door jam to be accommodated. This provides for various placements of the template with respect to the door for attendant mounting and routing of the recess into which a hinge is to be located after the routing takes place. All the foregoing features overcome the deficiencies of the prior art significantly to provide for a ready and accessable template that can be operated in a fast and facile manner with great accuracy and capability.

SUMMARY OF THE INVENTION

In summation, this invention comprises a routing template for door hinges having mounting means in the form of pins that are driven through the template and are pivotally removed by means of pivotal lever arms that are attached to the pins and are monted on the axle or rod within a bracket.

More particularly, the invention incorporates the provision of a template matching a recess that is to be routed out for mounting a hinge on a door jam. The template is formed as an opening within a board or flat planar structure. The board is indexed to the door jam or frame by means of its pre-established indexing for an appropriately sized opening that is to be routed for seating a hinge therein.

The template, and in particular, the board is mounted by means of a pin that is driven through the board. The pin is supported within the board by means of flanges or collars and a nut that holds the pin in place.

The pin has an enlarged head for driving purposes. Attached to the enlarged head of the pin is a lever arm having an opening therein for supporting the pin passing therethrough. The lever arm with the opening therein is pivotally connected by means of an axle or rod to a bracket. The bracket is mounted on the template in a manner whereby the lever arm can be forced backwardly after the pin has been driven in to remove the pin. In order to enhance the operation of the template holding means in the form of the pin and the lever, the lever is spring biased so as to hold the pin in the upper or non-driven position until it is driven.

The entire template is adjustable as to the margin at which it is seated against the door jam in order to provide for variously sized hinge openings. This is accommodated by means of a rotating disc that changes the relationship of the template opening to the door jam, depending upon the rotational orientation of the disc on the template.

All of the foregoing provide a facile and easily mounted template that can be mounted and rapidly and easily removed for routing door hinge seats.

BRIEF DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 1:
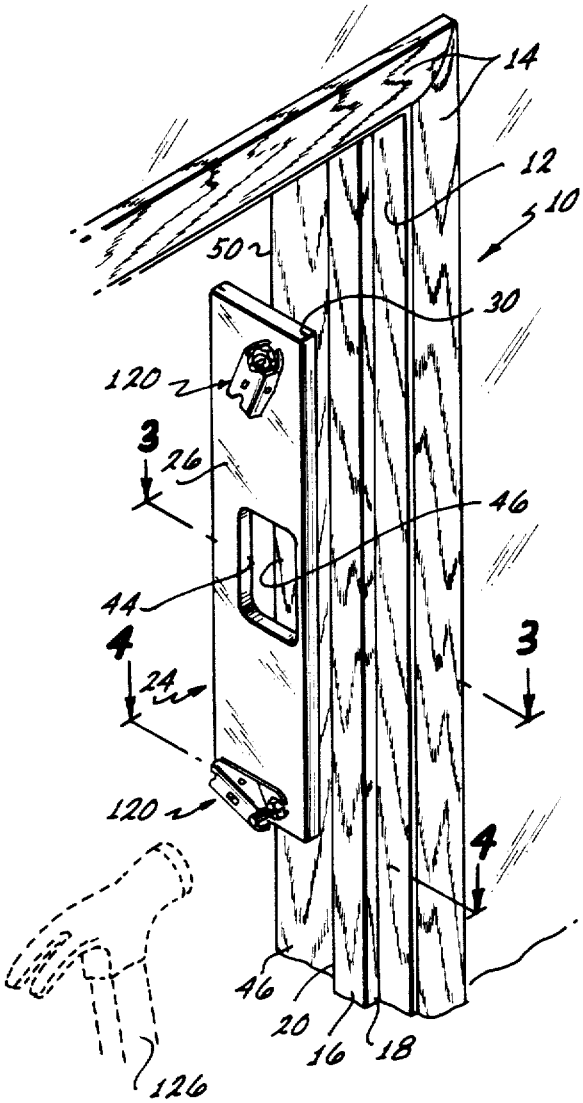
FIG. 1 shows a perspective view of a door jam with the template of this invention being mounted thereon for use, by means of a hammer shown in dotted form.
Figure 6:
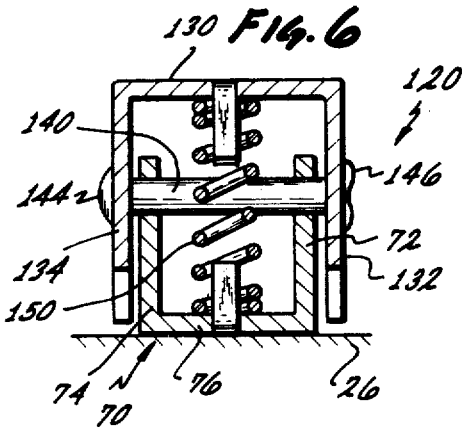
FIG. 6 shows a sectional view of the lever, bracket and rod of the lever removal means; and, FIG. 7 shows a view of the adjustment means as seen in the direction of lines 7—7 of FIG. 3.
Figure 7:
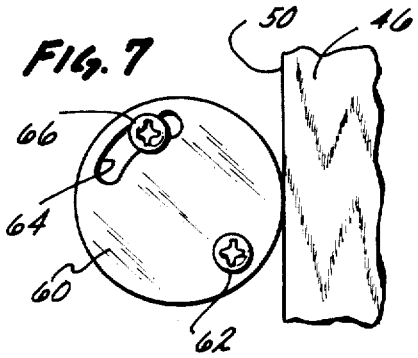

Looking at FIG. 1, it can be seen that a door jam 10 has been shown with a frame 12 therein. A molding 14 is shown in the way of a casing going around the outside thereof.

An inner frame 16 is shown against which a door normally closes. In effect, the inner frame 16 is a surface against which a door closes so as to seal the door. This surface can be in the form of surface 18 or surface 20. In this particular case, surface 20 is the surface against which a door can be closed in light of the placement of the hinge template described hereinafter.

The template that is the device comprising this invention, incorporates a generalized template configuration 24. The template configuration includes a board or plate 26. This board or plate 26 is configured such that it can be seated against the inside surface 20 of the inner frame 16. The template has a plastic edge region 30 that allows the template to be evenly spaced from the inner frame 16. The reason for the plastic 30 is to provide for a smooth and at the same time relatively abuse resistant surface. In this particular case, the plastic strip 30 has been shown seated within a groove 34 of the board 26 by means of a spline 36. This spline 36 allows the strip 30 to be seated therein in the form of a uniform T shaped member.

In like manner, a strip 40 is shown on the other surface having a similar spline and seating arrangement within an analogous groove. This thereby provides for a smooth secondary edge 40 for orienting the template in various locations.

Looking more particularly at the board 26, it can be seen that an opening 44 is provided. The opening 44 is such that it allows for a router to be moved around the edge regions of the opening 44. In this manner, the router moving around the edge regions of the opening 44 provides for orientation of the router with respect to a surface 46 of the frame so as to permit the routing out of the area or seat required for placement of a hinge.

The board 26 that provides the opening 44 for the router to go around the edges, can be made of any relatively planar material. It can also have certain guides, flanges, grooves, or other means to accommodate the edge region of a frame. It can also have adjustability so that the board 26 can move inwardly and outwardly with regard to the edge of the frame surface 46, such as edge surface 50. Suffice it to say, the basic concept is to allow for the opening 44 to be implaced against the surface 46 which is to be routed in order to provide for a hinge to be implaced in a groove, depression or seat therein.

Looking more particularly at the details of the invention, it can be seen that an edge or margin adjustment means is provided in the form of a disc 60. The disc 60 can be made of plastic or any other material. The disc 60 has a screw 62 and a slot 64 therein. The slot 64 is arcuate so that the disc 60 can pivot backwardly and forwardly around the axis of the screw 62.

The slot 64 has a set screw 66 therein which can be loosened or tightened to provide for different orientations of the disc 60 as it rotates around the screw 62. In this manner, the edge of the disc 60 with regard to the surface 50 can be oriented at different dimensions to provide for different placement of the opening 44 with regard to the surface 46. This thereby allows one to accommodate differently sized openings 44 and differently sized surfaces 46 of the door jam and frame 12.

Suffice it to say, other adjustment means as previously stated, can be utilized to allow for variously oriented boards 26 with regard to the edge region 50 of the frame 46. Such means can be adjustable tabs, pivotal marginal means, clamps, as well as a margin member that can be adjustably oriented with regard to screws along the surface of the board 26.

Looking more particularly at the pivotal lifting arms or levers of this device, it can be seen that a first bracket or support bracket 70 is shown. The support bracket 70 has two upstanding walls 72 and 74 with a cross member 76 or base.

The base 76 is mounted to the board 26 by means of a screw 80. The screw 80 can be seen mounting the bracket 70 on the board in a manner to provide for immobility of the bracket 70 when it is on the surface of the board 26.

The bracket 70 is held at its other end by means of a threaded cylinder 90. The threaded cylinder 90 passes through an opening of the board 26. It can be seated in any suitable manner. In this particular case it is shown seated by means of a shoulder 92 on the surface thereof that seats against a ledge 94 of the board 26 which has been bored on one side to provide a smaller diameter opening 98 and a larger diameter opening 100 to accommodate the shoulder and variably sized cylinder 90.

The cylinder 90 is held in place by means of threads 104 that receive a nut 106. The nut 106 is such that it provides for the securement of the cylinder 90 in the opening while at the same time tightening down on the base 76 of the bracket 70. The bracket 70 of course can be made of any particular type of material. However in this case, it is shown made of steel inasmuch as it provides a substantial amount of strength to the entire device.

In order to mount the bracket 70 by means of the nut 106 threading down on the cylinder 90, the bracket 70 can be slid by means of an open slot 110 up against the cylinder 90 near threads 94. This allows the slot 110 of the lower portion of the bracket 76 to be received thereagainst and is secured from movement by the screw 80 being turned down against the bracket to hold the bracket in place by virtue of an opening 81 of the lower portion 76 of the bracket receiving the screw. In this manner, when the nut 106 is threaded downwardly and the screw 80 is secured, the lower portion of the bracket 76 or base member is held in place to support the remaining portion of the invention as described hereinafter.

The foregoing bracket 70 supports a pivotal lever arm 120. The pivotal lever arm 120 is such that it provides for the function of lifting a pin 122 upwardly and downwardly within the cylinder or bushing 90.

The pin 122 has a sharpened end 124 which is driven into the wood frame 46 by means of a hammer 126.

The lever 120 comprises an upper lifting portion 130 with two cross or depending members 132 and 134. The foregoing substantially performs the function of providing a U channel. The U channel has a degree of strength that can be utilized for providing the lifting as will be detailed hereinafter.

The lifting lever 120 is journaled for rotation on a rod, axle or pin 140 that is received through the bracket arms 72 and 74. In this manner, it can pivot backwardly and forwardly on the rod 140. The rod 140 is spilled over on the ends, namely ends 144 and 146 forming buttons, or rivet ends, for securing the rod.

Figure 2:
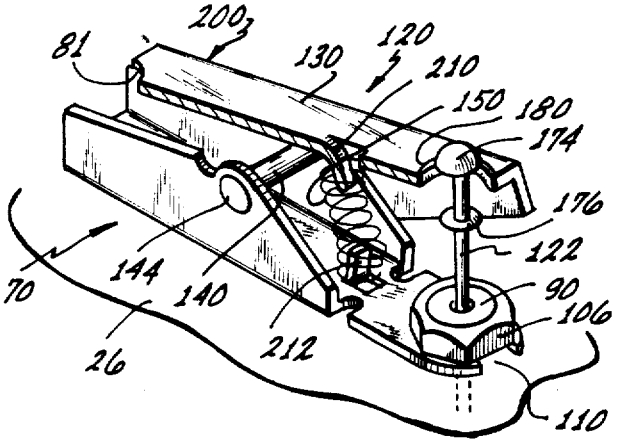
FIG. 2 shows a perspective view of the lever removal means and the bracket and spring bias means that accompanies the lever along with the pin that is removed thereby.
Figure 3:
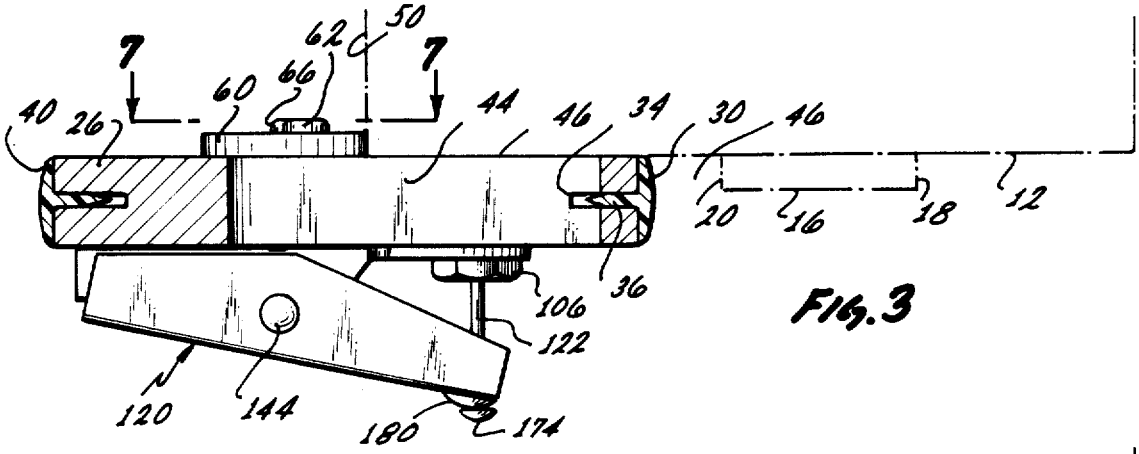
FIG. 3 shows a sectional view locking downwardly through the template in the direction of lines 3—3 of FIG. 1.
Figure 4:
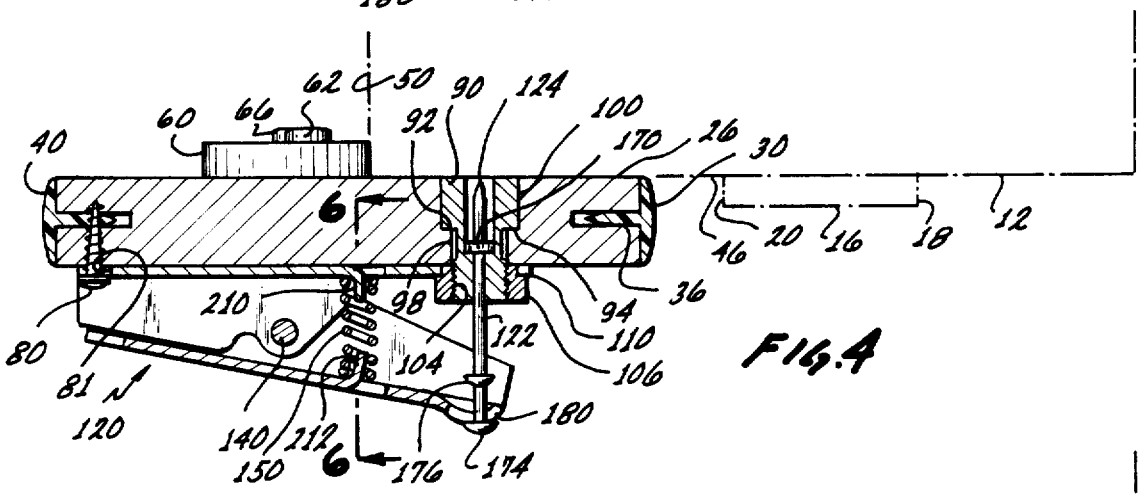
FIG. 4 shows a mid-line sectional view of the lever and pin as sectioned along lines 4—4 of FIG. 1, prior to the pin and template being mounted onto the door jam.

The lever arm 120 is normally in the position as shown in FIGS. 2, 3 and 4. In this position, a spring in the form of a coil spring 150 performs the function of lifting the lever arm 120 upwardly along with the pin 122. This removes the pin point 124 from the level of the board at its lower surface and the interface of the frame member 26 against which it would normally rest.

The pin 122 has an inner flange collar or stop 170 and an upper securement flange or collar 172 with a head 174. The head 174 and inner flange 170 provide the upper and lower extended areas of movement so as to create the overall travel through which the pin moves.

The pin 122 seats on a dimple or boss 180 that has been embossed into the upper portion of the arm or bracket 130. This embossment 180 effectuates a bearing surface for the pin in the manner whereby it is supported on a rounded surface for ease of movement.

When the template 24 is to be attached to the frame 12 the pin 122 as shown in FIG. 4 is driven by a hammer on the head 174 inwardly into the frame. After it is driven into the frame, a routing takes place in order to provide the opening for the hinge.

After the hinge position has been routed, the template 24 can be easily removed by knocking the other end of the lifting lever 120 namely at point 200 proximate thereto beyond the pivotal axis provided by the rod 140. This allows a lifting by the lever arm 120 of the pin head 174 upwardly, thereby pulling the pin 122 at point 124 out of the board surface 46.

Figure 5:
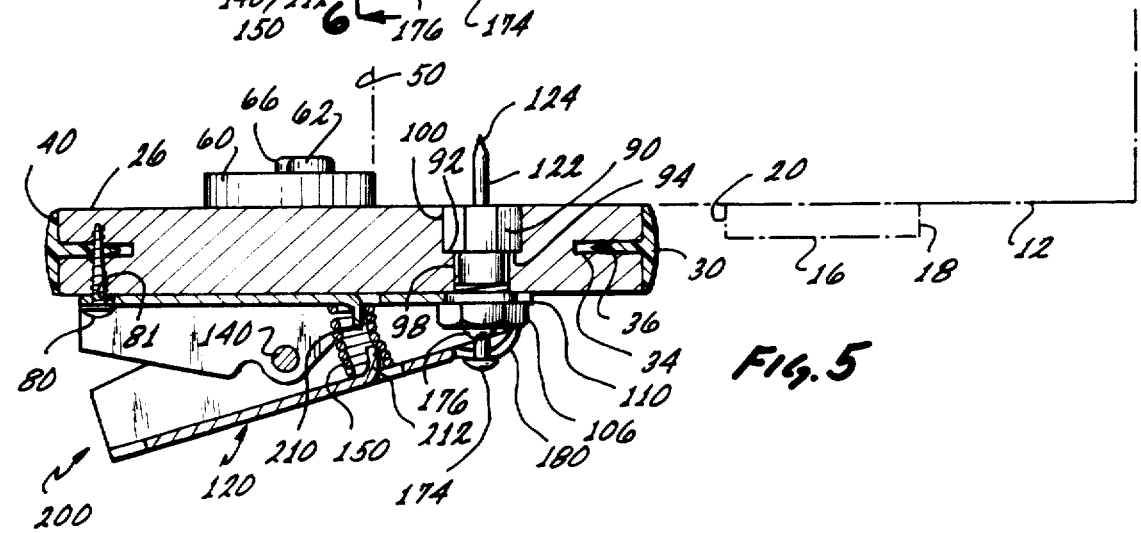
FIG. 5 shows the same sectional view as shown in FIG. 4 after the pin has been driven into the door jam and the template is mounted thereon.

For purposes of example, FIG. 4 is prior to the pin 122 being driven in for holding the template, while FIG. 5 shows the lever arm 120 having been driven downwardly by the pin 122 being driven into the surface so as to hold the pin into the wood with the template. For removal, the lever arm 120 is merely driven with the hammer at approximately point 200 or any position beyond the pivotal axle or rod 140 to remove the pin 122 from the wood that it has been driven into.

In order to hold the spring 150 in place, a pair of barbs or tabs 210 and 212 are expanded from member 130 and 76 respectively. These two tabs 210 and 212 receive the ends of a coiled spring 150 so as to allow them to remain in situ for holding the spring for movement of the lever 120 upwardly before it is driven. It also serves to hold the point 124 of the pin 122 so that it is not exposed from the side of the board from which it is driven out of.

From the foregoing, it can be seen that this template 24 can be easily used by merely driving in the pins 122 into the frame surface 46. After the routing has taken place in opening 44, the template is easily removed by merely driving a hammer against the lever arms 120 so as to lift the pins 122 outwardly from the wood and thereby remove the template.

From the foregoing specification, it can be seen that this invention is a broad step over the prior art and should be read broadly in light of its easy and facile placement of templates and removal therefrom for routing door frames for purposes of placing hinges therein.

I claim:

1. A template for providing a routing tool with a pre-established pattern wherein the improvement comprises:

means for forming a pre-established pattern that is to be routed;

means for securing said forming means into proximate connected relationship with an area that is to be routed in the form of at least a pin that is driven into said proximate area to be routed;

a pivoting lever;

a support upon which said lever is pivotally connected;

means for attachment of said support to said forming means; and, means for connecting said lever to said pin so that after said pin is driven into a surface that is to be routed said lever can be pivoted to remove said pin from the surface into which it has been driven.

2. The improved template as claimed in claim 1 further comprising:

a board having an opening for forming said pre-established pattern within said board.

3. The improved template as claimed in claim 2 further comprising:

spring biasing means for holding said pin in an undriven position until it is driven into an underlying surface.

4. The improvement as claimed in claim 2 wherein:

said pre-established pattern within said board forms an area for purposes of providing a template guide to route a hinge opening conforming thereto.

5. The improved template as claimed in claim 2 wherein:

said support upon which said lever is pivotally connected is in the form of a bracket which holds a rod upon which said lever is journaled.

6. The improved template as claimed in claim 5 wherein:

said lever arm is biased by a spring which lifts said lever arm upwardly and said pin that is connected thereto prior to said pin being driven into an underlying surface.

7. The improved template as claimed in claim 6 further comprising:

a stop means on said pin in combination with a stop surface in said board to check the upward movement of said pin under said spring bias.

8. A board type template of the type wherein a board is placed onto a surface for routing a hinge opening by a router moving within an opening of said board, wherein the improvement comprises:

at least one pin connected to said board for driving into a surface which is to be routed to hold said template in place, wherein said pin is mounted through said template for holding it in place;

a bracket in adjacent relationship to said pin secured to said board; and, a pivotal lever arm attached to said bracket for pivoting on said bracket having means for attachment to said pin for lifting said pin by said lever so that said pin can be driven into an adjacent surface to said template and later removed therefrom by driving said lever in the opposite direction from whence it was driven into said board in connected relationship to said pin.

9. The improved template as claimed in claim 8 further comprising:

spring biasing means for holding said lever in an upper position with said pin so that said pin is lifted upwardly by said spring biasing means in an upper articulated position by said spring bias prior to being driven through said board to said underlying surface.

10. The improved template as claimed in claim 9 further comprising:

a bushing within said board through which said pin passes;

stop means on said pin and shoulder means on said bushing for preventing the movement of said pin upwardly and outwardly from said board by said spring.

11. The improved template as claimed in claim 10 further comprising:

a head on said pin overlying said lever; and, underlying securement means for securing said head to said lever so that said lever can move and lift said pin within the space between said head and said underlying securement means.

12. The improved template as claimed in claim 11 further comprising:

adjustment means for adjusting the margin of said template with respect to an adjacent surface.

13. The improved template as claimed in claim 12 wherein said adjustment means comprises:

a circular member pivotally oriented on a pivotal axis; and, having adjustment means in the form of a screw passing therethrough to adjust the rotational placement of said circular member with respect to an adjacent surface.

14. An improved door hinge template for providing a routing guide to route a door frame for a hinge seat comprising:

a template plate having an opening therein of an appropriate size for routing an opening conforming to said template opening and the general outline of a hinge to be mounted;

pin means supported within said template plate having a sharpened end and a head for driving said pins into an adjacent frame for securing said template plate to said frame;

a pivotal lever attached at one end to said pin and having a driving end at the other end for allowing a force to be imposed thereon, such as by driving a hammer thereagainst; and, mounting means for pivotally mounting said lever so that when said driving end is driven and said pin is within a frame, it is lifted therefrom by said lever.

15. The improved template as claimed in claim 1 wherein:

said lever is spring biased so as to lift said pin upwardly prior to being driven into an underlying surface.

16. The improved template as claimed in claim 1 wherein:

said pin is mounted through a bushing in said template plate that is secured thereinto by means of a nut securing said bushing into said plate.

17. The improved template as claimed in claim 16 further comprising:

support means for supporting said pivotal arm in the form of a bracket having one end thereof secured to said template by means of said nut and said bushing wherein said nut overlies said bracket and secures it to said bushing onto said plate; and, stop means on said pin within said bushing for preventing said pin from being lifted outwardly by the bias of said spring.

18. The improved template as claimed in claim 17 further comprising:

a coil spring for biasing said lever upwardly;

tangs depending from said lever and upstanding from said bracket for passing inwardly into said spring for securing it between said lever and said bracket;

pivotal mounting means in the form of a rod passing through said bracket and said lever for allowing said lever to pivot thereon; and, screw means in addition to said bushing and nut for passing through said bracket to secure said bracket to said template plate.

* * * * *